US007857707B2

(12) United States Patent
Beppu

(10) Patent No.: US 7,857,707 B2
(45) Date of Patent: Dec. 28, 2010

(54) GOLF CLUB

(76) Inventor: Kazumasa Beppu, 9, 1-gaiku, 1-bancho, Kikyogaoka Minami, Nabari-shi, Mie-ken, 518-0631 (JP)

( * ) Notice: Subject to any disclaimer, the term of this patent is extended or adjusted under 35 U.S.C. 154(b) by 137 days.

(21) Appl. No.: 12/294,140

(22) PCT Filed: Mar. 23, 2007

(86) PCT No.: PCT/JP2007/056092

§ 371 (c)(1),
(2), (4) Date: Sep. 23, 2008

(87) PCT Pub. No.: WO2007/111272

PCT Pub. Date: Oct. 4, 2007

(65) Prior Publication Data

US 2009/0149269 A1 Jun. 11, 2009

(30) Foreign Application Priority Data

Mar. 24, 2006 (JP) ..... 2006-082751

(51) Int. Cl.
*A63B 69/36* (2006.01)

(52) U.S. Cl. ..... 473/256; 473/297

(58) Field of Classification Search ..... 473/234, 473/242, 256, 282, 291, 292, 297, 316–318, 473/326, 333–339, 346, 349
See application file for complete search history.

(56) References Cited

U.S. PATENT DOCUMENTS 4,715,606 A * 12/1987 Varley ..... 473/256
5,082,279 A * 1/1992 Hull et al. ..... 473/242
5,634,856 A * 6/1997 Rainey ..... 473/234

(Continued)

FOREIGN PATENT DOCUMENTS

| | | |
|---|---|---|
| JP | 62-41673 | 2/1987 |
| JP | 8-187310 | 7/1996 |
| JP | 10-5381 | 1/1998 |
| JP | 2002-253721 A1 | 9/2002 |

OTHER PUBLICATIONS

International Search Report for International Application No. PCT/JP2007/056092 dated May 10, 2007.

*Primary Examiner*—Nini Legesse
(74) *Attorney, Agent, or Firm*—Kratz, Quintos & Hanson, LLP

(57) ABSTRACT

A golf club which helps master a proper swing path is provided. A golf club includes a hollow shaft; a club head at a tip portion of the shaft; a grip at a base end portion of the shaft; and a balance-shifting unit which increases a swing balance of the golf club. The balance-shifting unit includes a partitioning portion which divides an inside space of the shaft into a first portion on the base end portion side and a second portion on the tip portion side; and a balancing material. The partitioning portion includes a first shifter portion which allows the balancing material held in the first portion to move to the second portion side in association with a swing; and a second shifter portion which allows the balancing material on the second portion side to return to the first portion. The golf club further includes a balance holder.

6 Claims, 6 Drawing Sheets

U.S. PATENT DOCUMENTS 5,803,829 A * 9/1998 Hayashi ..... 473/326
6,019,687 A * 2/2000 Blowers ..... 473/326
7,090,589 B2 * 8/2006 Andersen ..... 473/256
7,144,329 B2 * 12/2006 Tamura ..... 473/223

* cited by examiner

Wood Type (a) Non-Shaft-Penetration (b) Shaft-Penetration

Iron Type (a) Non-Shaft-Penetration (b) Shaft-Penetration

GOLF CLUB

FIELD OF THE INVENTION

The present invention relates to a golf club, and more specifically to a practice golf club for mastering a proper swing path.

BACKGROUND ART

A golf swing is composed of a sequence of swing actions starting from an address, a back swing, a top swing, a down swing which leads to an impact and then through a follow-through, coming to a finish. During this series of swing actions from address to finish, the club head moves in a circular path. By making a swing so that the lowest point of the circular path is the ball position, it becomes possible to drive the ball accurately toward a target. A plane which contains the circular path made by the club head when such a swing is made is called swing plane. If the club head travels out of the swing plane during the swing, the ball is likely to make slice rotation or hook rotation.

Therefore, in order to stabilize shots, it is necessary to master a proper swing path along the swing plane. However, since the golfer cannot see his swing path by himself, it is not easy to master a proper swing path. Especially, there is a major tendency in many beginners that their swing often causes the ball to make slice rotation. One reason for this is that people only use their arms when swinging the golf club, which tends to make the club head travel on a far side away from the body. In other words, the club head passes outside of the swing plane and because of this, the ball tends to get a clockwise spin (when the player is right-handed) at the time of impact. Such being the situation, there is proposed a practice device which allows the player to check his swing path.

For example, Patent Document 1 discloses a practice golf club which includes a club head attached with a bar member provided with a luminescent body, so that the swing path can be checked by watching a path of light from the luminescent body around the point of impact when the club is swung.

Also, Patent Document 2 discloses a practice device which includes a cord-like member having its one end detachably attached to a club head and the other end disposed at a ball position when the player makes an address; and a detection member attached to the grip of a club as an indication of a simulated position of the swing plane. As the club head moves, the cord-like member draw a path, which is detected by the detection member, so that a player can check his swing path.

Further, there are known simpler practice methods for mastering a proper swing path without using such dedicated devices as described above. An example is attaching a weight to the club head and another example is using two clubs, for repeated practice of a swing. These methods are based on a fact that a heavy golf club is difficult to swing with the arms alone and therefore can naturally lead the player to an integral use of his arms and body which is essential in an ideal swing action. The player may not be aware particularly of the swing plane, yet he is able to make his swing path closer to a proper swing plane. Therefore, it is possible to expect that a proper swing path will be learned by practice in repeating a swing by using such a method as described above.

Patent Document 1: JP-A Hei 10-5381

Patent Document 2: JP-A 2002-253721

DISCLOSURE OF THE INVENTION

Problems to be Solved by the Invention

However, techniques described in Patent Documents 1 and 2 are not for a type of practice where the golfer actually hits a ball in the process of correcting his swing path, and therefore it is impossible to check whether or not he can make a swing on a proper swing path when he actually hits a ball. In other words, he may concentrate on his swing path in his practice swings but when he makes an actual shot, his concentration may be diverted to making a hit on the ball, and this often brings the golfer into a tendency that he can make a correct swing when making a practice swing but cannot make the same correct swing path when he actually hits the ball. In order to eliminate the tendency, he has to practice repetitive pattern drills until he becomes able to make his swings on a correct swing path unconsciously. However, repeating the same practice of checking the swing path without hitting a ball is monotonous, and there is no opportunity for the golfer to see his shot and check his improvement. Therefore, it is in fact not easy to keep exercising a repetitive practice.

As for the above-described method of using a heavy club in the practice, simple repeating of a swing may correct the swing path naturally, and therefore it is easy for the body to learn a proper swing path. However, as in the techniques in Patent Documents 1 and 2, it is not possible to actually hit balls in the exercise, and therefore it is impossible for the golfer to check whether or not he can make a swing on a proper swing path when he actually hits balls, and in addition, it is a monotonous practice which is difficult to keep exercising the repetitive practice. Furthermore, a practice of swinging a heavy club repeatedly requires a certain level of basic physical strength without which there is a possibility of hurting the body, yet most beginner golfers usually do not have the level of basic physical strength which is required in golf swings.

By the way, a practice exercised most enthusiastically by general amateur golfers is to actually hit balls in a golf driving range, since they can take the joy of actually hitting the balls and check how the balls fly. Therefore, a practice which will allow golfers to easily master a proper swing path while they can actually hit balls in the driving range will provide the general amateur golfers with a meaningful method of practice.

Therefore, a primary object of the present invention is to provide a golf club which helps master a proper swing path easily without too much burden while hitting balls.

Means for Solving the Problems

According to an aspect of the present invention, there is provided a practice golf club which includes a hollow shaft; a club head provided at a tip portion of the shaft; a grip provided at a base end portion of the shaft; and balance-shifting means for increasing a swing balance of the golf club in association with a swing of the golf club.

According to the present invention, the swing balance of the golf club increases each time the player swings the golf club. In other words, it is possible to increase a swing load gradually each time the swing is made. Therefore, it is possible to gradually induce a swing action achieved by integral use of the arms and the body while the player may not be particularly aware and while avoiding abrupt increase in the swing load on the player's muscles, joints and other parts of the body. As a result, it is possible to correct the swing path without too much burden, to make muscle training for the swing and to improve on head speed and swing power. Further, the player can hit balls just as with a normal golf club, so he should only concentrate on hitting the ball at a golf driving range just as he would do in his normal round of play in order to correct his swing path. Thus, it becomes possible to master a proper swing path easily without too much burden while actually hitting balls.

Preferably, the balance-shifting means includes a partitioning portion for dividing an inside of the shaft into a first portion on the base end portion side and a second portion on the tip portion side; and a balancing material. With this arrangement, the partitioning portion includes a first shifter portion for moving the balancing material held in the first portion to the second portion side in association with a swing of the golf club. In this case, it is possible to provide the balance-shifting means inside a hollow portion of a shaft of a commercially available normal golf club. Therefore, while offering all functions as provided in existing normal golf clubs, it becomes possible to change the swing balance easily, by shifting the balancing material inside the golf club.

Further preferably, the first shifter portion includes a first communication portion which has a holder portion for holding a predetermined amount of the balancing material from the first portion and provides communication between the first portion and the second portion via the holder portion; and a first valve mechanism capable of opening and closing an opening on the second portion side of the holder portion. With this arrangement, the first valve mechanism opens the opening on the second portion side of the holding portion by using a centrifugal force generated by a swing of the golf club. In this case, a centrifugal force, which is generated by a swing of the golf club and acting in a direction from the base end portion toward the tip portion of the golf club, is utilized to activate the first valve mechanism to open the opening on the second portion side in the holder portion, so that the balancing material which was held in the holder portion moves to the second portion side. By using the first valve mechanism which is activated by a centrifugal force as described, it becomes possible to constitute the balance-shifting means which is not dependent upon a dedicated drive-power source (such as a motor) or upon a starting operation by the player for moving the balancing material. Therefore, it becomes possible to constitute the balance-shifting means simply and in small size, which facilitates mounting into the golf club. Also, the player does not have to disturb himself in order to make a shifting operation of the swing balance in his practice, which can enhance the effectiveness of repetition.

The balancing material inside the first portion may be moved to the second portion in association with a swing of the golf club. In this case, the balancing material shifts inside the golf club shaft, so any club head, whether it is a solid type or a hollow type, may be attached to the tip of the shaft.

Also, the balancing material inside the first portion may be allowed to move to inside of the club head via the second portion in association with a swing of the golf club. In this case, the balancing material shifts between the shaft and the club head of the golf club and therefore, it becomes possible to increase the range in which the swing balance changes, i.e., the effectiveness of shifting. Also, as the position of the partitioning portion in the shaft is made closer to the base end portion of the shaft, the balancing material moves in a longer distance, and in this way, it is possible to increase the range in which the swing balance changes, i.e., to increase the effectiveness of shifting.

Further, preferably, the golf club includes a balance holder for restraining the balancing material, which was moved to the second portion side, from returning to the first portion during a swing of the golf club. In this case, it becomes possible to restrain the balancing material which has moved to the second portion side from returning to the first portion while a swing is being made, and therefore it becomes possible to avoid reversing of the shift balance which has been increased by the swing and to maintain the shift balance.

Preferably, the partitioning portion further includes a second shifter portion for returning the balancing material on the second portion side to the first portion. As the golf club is swung repeatedly, the balancing material inside the first portion moves through the first shifter portion to the second portion side, i.e., into the second portion or into the club head, and the swing balance of the golf club increases. Then, if it is desired that the swing balance should be decreased, it is possible to decrease the swing balance of the golf club by returning the balancing material which was shifted to the second portion side, to the first portion via the second shifter portion. This is advantageous particularly when resetting the swing balance to a minimum after it has reached a maximum. This arrangement allows repeated practice with the golf club.

Further preferably, the second shifter portion includes a second communication portion for providing communication between the second portion and the first portion for moving the balancing material from the second portion side to the first portion; and a second valve mechanism capable of opening and closing the second communication portion. With this arrangement, the second valve mechanism uses its weight to open the second communication portion. In this case, when returning the balancing material which was shifted to the second portion side to the first portion, it is only required to keep the golf club in a certain attitude, i.e., with the club head on the upside and the grip on the downside, and then the second valve mechanism will open the second communication portion using the weight of the mechanism itself. Thus, the balancing material on the second portion side moves due to its weight, through the second communication portion toward the first portion, and decreases the swing balance. Therefore, there is no need for a dedicated drive-power source (such as a motor) in order to return the balancing material to the first portion, and it is possible to simplify the structure of the golf club.

The above-described object, other objects, characteristics, aspects and advantages of the present invention will become more apparent from the following detailed description of embodiments to be made with reference to the attached drawings.

BRIEF DESCRIPTION OF THE DRAWINGS

FIG. 2(*b*) is a sectional view taken in lines A-A thereof.

FIG. 6(*a*) is a non-shaft-penetration type whereas FIG. 6(*b*) is a shaft-penetration type.

FIG. 6(*a*) is a non-shaft-penetration type whereas FIG. 6(*b*) is a shaft-penetration type.

| Legend | |
|---|---|
| 10 | Golf club |
| 12, 18 | Hollow portions |
| 14 | Shaft |
| 16 | Tip portion |
| 20, 20a, 20b | Club heads |
| 22 | Base end portion |
| 24 | Grip |
| 26 | Balance-shifting means |
| 28 | First portion |
| 30 | Second portion |
| 32 | Partitioning portion |
| 34 | Balancing material |
| 36 | Balance holder |
| 46 | First shifter portion |
| 48 | Second shifter portion |
| 50 | First communication portion |
| 52 | Holder portion |
| 54 | Release channel |
| 58 | Opening |
| 66 | First valve mechanism |
| 72 | Second communication portion |
| 78 | Second valve mechanism |

BEST MODE FOR CARRYING OUT THE INVENTION

Hereinafter, embodiments of the present invention will be described with reference to the drawings.

Figure 1:
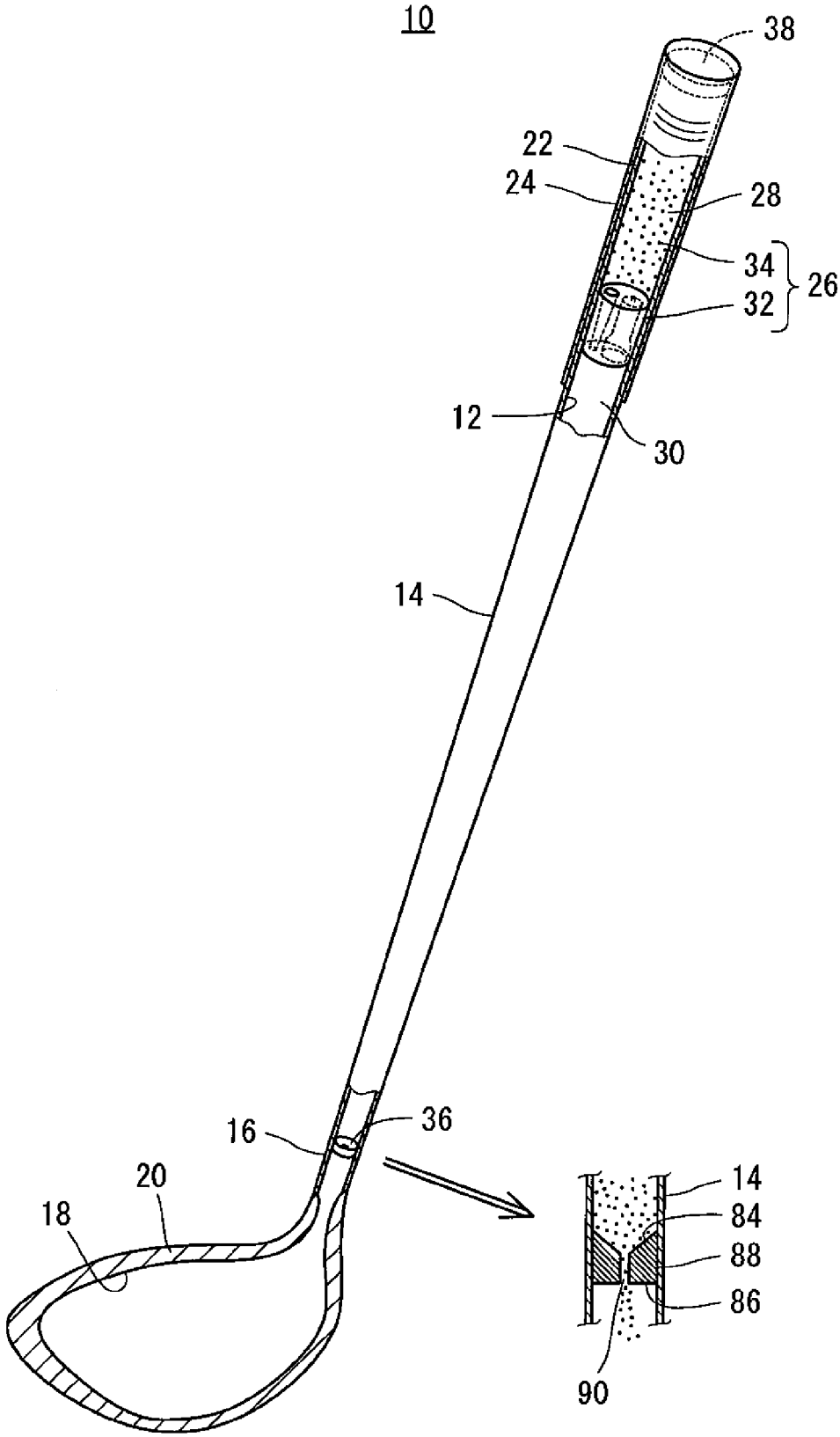
FIG. 1 is a diagram showing a general configuration of a golf club.

Referring to FIG. 1, a golf club 10 according to an embodiment of the present invention is a practice golf club, and includes a shaft 14 which has a hollow portion 12; an wood-type club head 20 which is provided at a tip portion 16 of the shaft 14 and has a hollow portion 18; and a grip 24 which is provided at a base end portion 22 of the shaft 14. The shaft 14 is made of steel or carbon for example, and has a total length of 44.5 inches. The shaft 14, the club head 20 and the grip 24 may each be provided by commercially available golf club parts. The golf club 10 has nothing that would look differently from a commercially available normal golf driver, but incorporates therein balance-shifting means 26. The balance-shifting means 26 includes a partitioning portion 32 which divides the hollow portion 12 in the shaft 14 into a first portion 28 on the base end portion 22 side and a second portion 30 on the tip portion 16 side; and a balancing material 34 housed in the first portion 28. The partitioning portion 32 is disposed on the base end portion 22 side inside the shaft 14. Also, a balance holder 36 is provided inside the second portion 30.

The balancing material 34 functions as a weight for changing a swing balance. It is preferable that the balancing material 34 is provided by a nonmagnetic fluid which flows smoothly without making a clog inside the shaft 14 and thereby can shift the swing balance. In the present embodiment, the balancing material 34 is provided by glass power having a grain diameter of approximately 150 μm, for inexpensiveness and ease of handling. The balancing material 34 is supplied from an opening in the base end portion 22 of the shaft 14 to the first portion 28, under a state where the partitioning portion 32 is disposed inside the shaft 14. Thereafter, a cap 38 is attached to the opening in the base end portion 22 and further, a grip 24 is mounted on the base end portion 22 of the shaft 14. Attaching the cap 38 as an internal lid to the opening at the base end portion 22 provides good operability when replacing the grip 24 for example. It should be noted here that the opening at the base end portion 22 may be closed by the grip 24 alone, without using the cap 38.

Next, the partitioning portion 32 will be described with reference also to FIG. 2(*a*) and FIG. 2(*b*).

The partitioning portion 32 is fixed to an inner circumferential surface of the shaft 14, at a position to allow the first portion 28 to hold a predetermined amount of the balancing material 34. In the present embodiment, the partitioning portion 32 is disposed at approximately 40 inches away from the tip of the club head 20 so that the first portion 28 will have a capacity to hold the balancing material 34 which is provided by approximately 40 grams of the glass power.

The partitioning portion 32 is a cylindrical body which has substantially the same outer diameter as an inner diameter of the base end portion 22 in the shaft 14; has an end surface 40 on the first portion 28 side, an end surface 42 on the second portion 30 side, and a side surface 44 which makes contact with the inner circumferential surface of the shaft 14; and is made of a nonmagnetic material such as resin.

The partitioning portion 32 includes a first shifter portion 46 for allowing the balancing material 34 to move from the first portion 28 to the second portion 30 side; and a second shifter portion 48 for allowing the balancing material 34 which has moved to the second portion 30 side to return to the first portion 28. As in FIG. 2, the first shifter portion 46 is formed slightly on the right-hand side, off the axial center of the partitioning portion 32 while the second shifter portion 48 is formed slightly on the left-hand side, off the axial center of the partitioning portion 32.

The first shifter portion 46 includes a first communication portion 50 which allows communication between the end surfaces 40 and 42, i.e., between the first portion 28 and the second portion 30. The first communication portion 50 includes a holder portion 52 which holds a predetermined amount of the balancing material 34 from the first portion 28; and a release channel 54 for releasing the balancing material 34 which was held by the holder portion 52. The holder portion 52 communicates with the first portion 28 via an intake opening 56, extends axially of the partitioning portion 32, and has an opening 58 on the second portion 30 side. The release channel 54 has a tapered portion 60 continuing from the opening 58 of the holder portion 52 and increasing in diameter toward the second portion 30 side; an extended portion 62 continuing from the tapered portion 60 and extending toward the second portion 30 side; and a release opening 64 representing an end edge of the second portion 30 side. The intake opening 56 and the release opening 64 are disposed in such a relationship that a line drawn to connect their respective centers lies substantially axially of the shaft 14.

Also, the first shifter portion 46 includes a first valve mechanism 66 for controlling the movement of balancing material 34 from the first portion 28 to the second portion 30 side (inside the club head 20 according to the present embodiment). The first valve mechanism 66 includes a ring-like member 68 which is made of metal for example, and is fixed to the opening 58 on the second portion 30 side in the holder portion 52; a valve body 70 which is provided inside the release channel 54 and is attachable/detachable to and from the ring-like member 68; and a stopper 71 which is fixed to block part of the release channel 54 near the release opening 64 in the extended portion 62 of the release channel 54. The stopper 71 is made of nonmagnetic material such as resin, and is formed like a bar.

The valve body 70 is provided by a columnar magnet of a predetermined magnetic power, and has an outer diameter which is equal to the ring-like member 68 and smaller than the diameter of the release opening 64. The valve body 70 is displaceable, being capable of taking a closed state (holding state) which is a state of being attached to the ring-like member 68 as shown in solid lines in FIG. 2, as well as taking an open state (supplying state) which is a state of being detached from the ring-like member 68 in a direction indicated by an arrow a while being supported by the stopper 71 as shown in dashed lines in FIG. 2. In the closed state, the opening 58 in the holder portion 52 is closed by the ring-like member 68 and the valve body 70 so that there is no gap therebetween. On the other hand, in the open state, the opening 58 in the holder portion 52 is opened, and it becomes possible to release the balancing material 34 from the holder portion 52. It should be noted here that the magnetic power of the valve body 70 is set to a strength which allows the valve body 70 to be detached from the ring-like member 68 (switching from the closed state to the open state) by a centrifugal force at the time of impact during the series of swing actions.

The second shifter portion 48 is provided adjacent to the first shifter portion 46, and includes a second communication portion 72 which allows communication between the end surfaces 40 and 42 of the partitioning portion 32. The second communication portion 72 is formed like a frustum of a cone extending with an increasing diameter, from an inflow opening 74 on the end surface 42 side to an outflow opening 76 on the end surface 40 side. The inflow opening 74 is an opening for allowing the balancing material 34 to flow from the second portion 30 (inside the club head 18 according to the present embodiment) side into the second communication portion 72 whereas the outflow opening 76 is an opening for allowing the balancing material 34 which flew into the second communication portion 72 to flow out to the first portion 28. The inflow opening 74 and the outflow opening 76 are disposed in such a relationship that a line drawn to connect their respective centers lies substantially axially of the shaft 14.

Also, the second shifter portion 48 includes a second valve mechanism 78 for controlling the movement of balancing material 34 from inside the club head 20 to the first portion 28.

The second valve mechanism 78 includes a valve body 80 disposed inside the second communication portion 72, and a stopper 82 which is fixed to block part of the second communication portion 72 near the outflow opening 76 in the second communication portion 72. The valve body 80 is formed like a ball, made of metal, for example, has an outer diameter which is greater than the diameter of the inflow opening 74 and smaller than the diameter of the outflow opening 76, and has a predetermined weight. The stopper 82 is made of non-magnetic material such as resin, and is formed like a rod.

Figure 2:
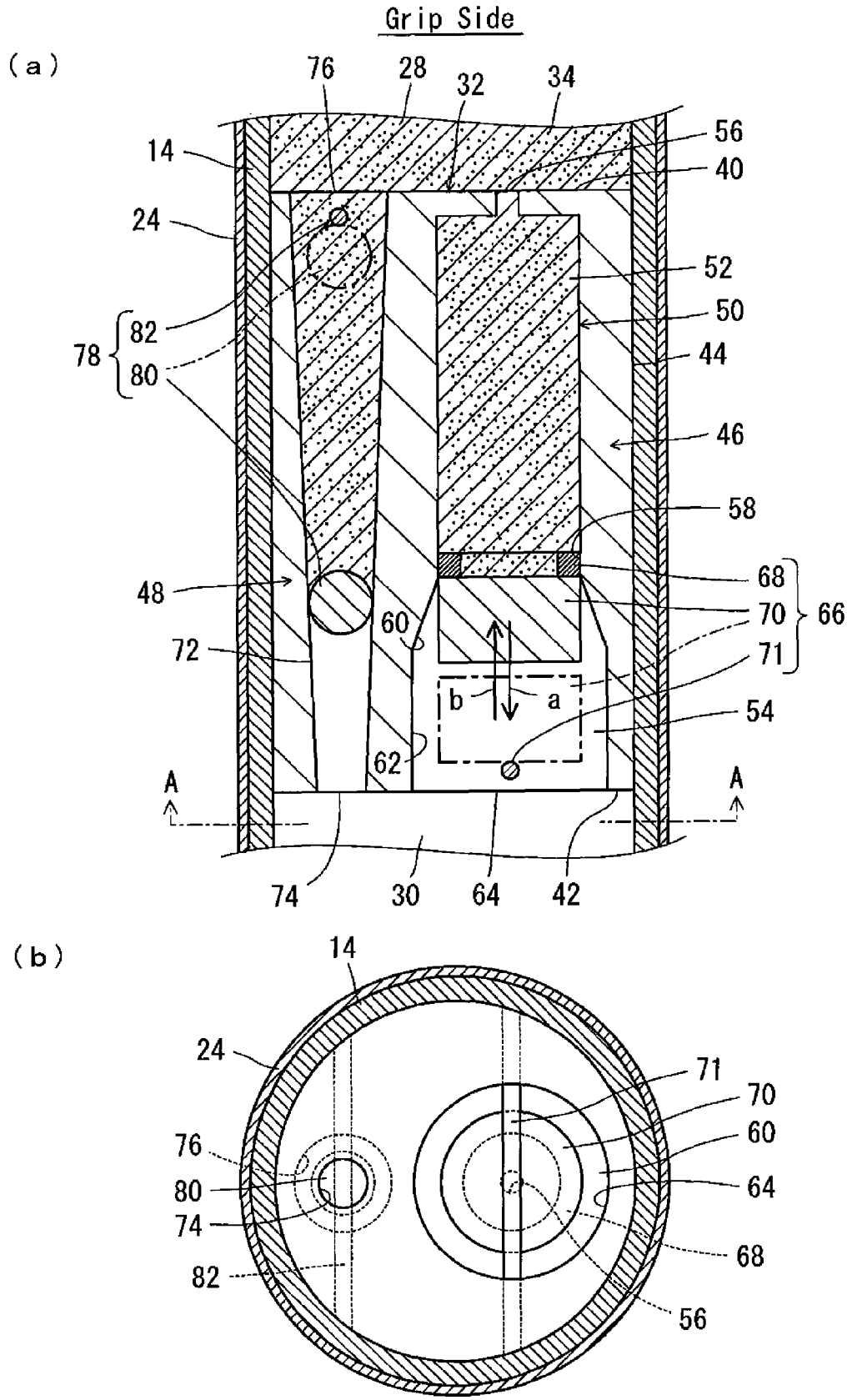
FIG. 2(*a*) is a longitudinal sectional view showing a configuration of a partitioning portion, with a club head pointing downward.

The valve body 80 is displaceable, being capable of taking a closed state (holding state) which is a state of closing the second communication portion 72 as shown in solid lines in FIG. 2, as well as taking an open state (supplying state) which is a state of opening the second communication portion 72 and supported by a stopper 82 as shown in dashed lines in FIG. 2.

In other words, the valve body 80 is displaceable inside the second communication portion 72, in the direction of gravity acting thereon. Therefore, in the closed state where the gravity acts toward the inflow opening 74, movement of the valve body 80 is limited at a position close to the inflow opening 74 in the second communication portion 72 (i.e., where the inner diameter of the second communication portion 72 becomes not greater than the outer diameter of the valve body 80), and the second communication portion 72 is closed by the valve body 80. On the other hand, in the open state where the gravity acts toward the outflow opening 76, movement of the valve body 80 is limited by the stopper 82 and a gap is formed between the valve body 80 and an inner surface of the second communication portion 72, whereby the second communication portion 72 is opened, making it possible for the balancing material 34 to flow out from the second communication portion 72.

Referring to FIG. 1, the balance holder 36 is provided near the tip portion 16 inside the shaft 14, and limits a returning flow of the balancing material 34 from inside the club head 20 to the first portion 28 of the shaft 14 during swing actions.

The balance holder 36 is substantially hollow cylindrical, has an outer diameter which is substantially equal to the inner diameter of the tip portion 16 to which the club head 20 is attached, and is made of resin for example. The balance holder 36 has an end surface 84 on the base end portion 22 side of the shaft 14; an end surface 86 on the tip portion 16 side of the shaft 14; a side surface 88 which makes contact with the inner circumferential surface of the shaft 14; and a communication hole 90 which connects a center portion of the end surface 84 with a center portion of the end surface 86. The side surface 88 of the balance holder 36 is fixed to the inner circumferential surface of the tip portion 16 side of the shaft 14.

The end surface 84 is tapered, with a diameter decreased gradually toward the center, facilitating the inflow of the balancing material 34 from the end surface 84 side to the communication hole 90. On the other hand, the end surface 86 is formed as a flat surface, which limits unnecessary inflow of the balancing material 34 from the end surface 86 side to the communication hole 90.

Figure 3:
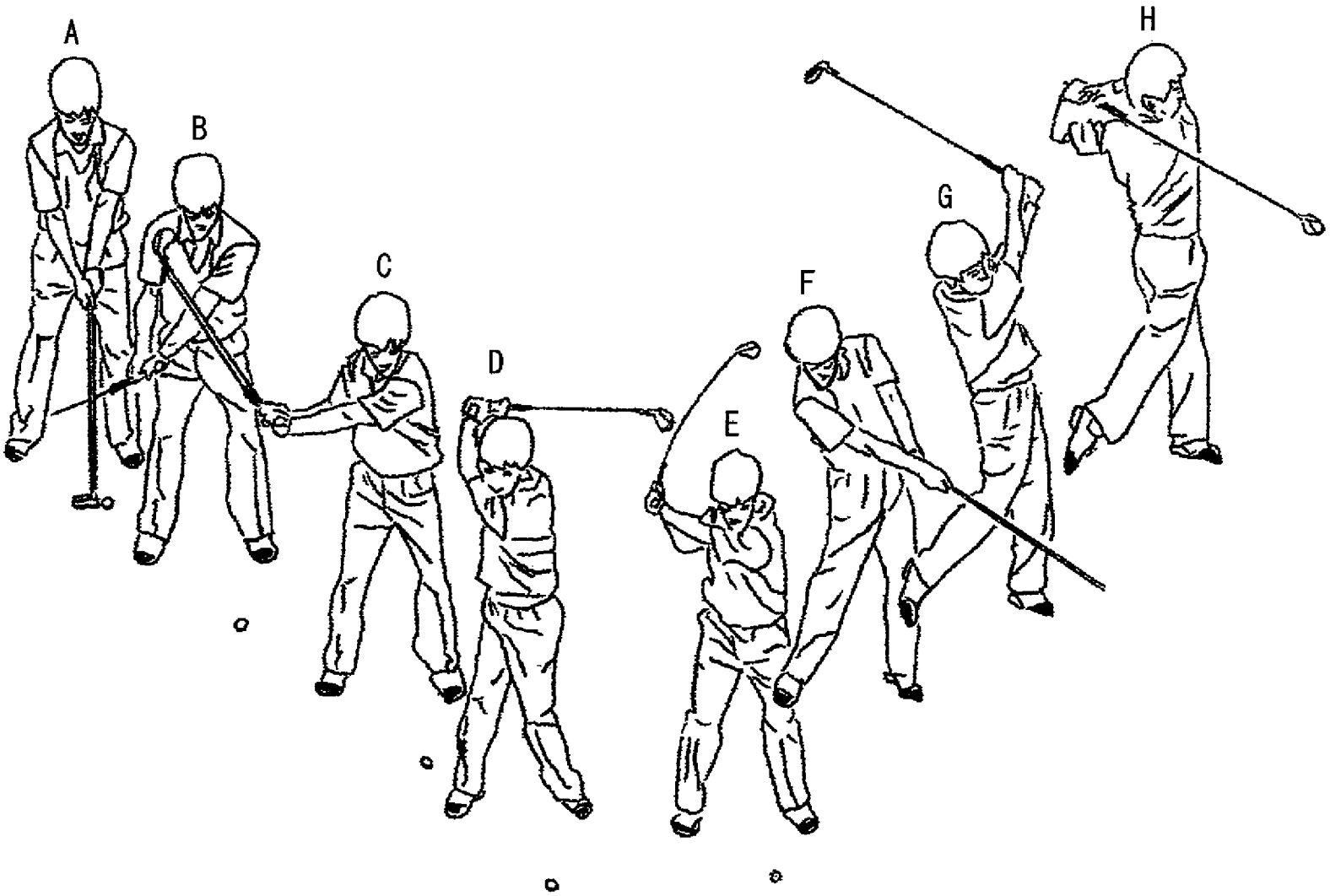
FIG. 3 is a diagram showing swing actions.

Hereinafter, a function which associates with a movement of the golf club 10 will be described with reference to FIG. 3.

First, as shown in FIG. 1, all of the balancing material 34 is placed in the first portion 28 to minimize the swing balance. Under this state, as the player holds on the grip 24 of the golf club 10 and makes an address (A in FIG. 3), the balancing material 34 inside the first portion 28 is introduced into the holder portion 52 by approximately one gram via the intake opening 56, and this state stays.

As the player starts his swing and as the swing proceeds from the back swing (B through C in FIG. 3) to the top swing (D in FIG. 3), the valve bodies 70 and 80 come to their respective closed state shown in solid lines in FIG. 2.

Subsequently, in the process from the top swing (D in FIG. 3) through the down swing (E in FIG. 3), then the impact and the follow-swing (E through G in FIG. 3), the swing by the player exerts a centrifugal force to the golf club 10 in the direction toward the club head 20. As the centrifugal force exceeds the force which attaches the valve body 70 to the ring-like member 68, the valve body 70 comes off the ring-like member 68, moves in the direction indicated by the arrow a in FIG. 2 and comes to the open state of being supported by the stopper 71 as shown in dashed lined in FIG. 2.

In the open state, approximately one gram of balancing material 34 which was held in the holder portion 52 is released through the release channel 54 and the release opening 64, to the second portion 30 side. Due to its gravity as well as to the centrifugal force at the time of the swing, the balancing material 34 released from the release opening 64 flows through the shaft 14 toward the tip portion 16, then through the communication hole 90 in the balance holder 36, and comes inside the club head 20.

Subsequently, the follow-swing (C in FIG. 3) ends and the finish (H in FIG. 3) is made, upon which a series of swing actions (one swing) is completed. During the process from the follow-swing (G in FIG. 3) to the finish (H in FIG. 3), the valve body 70 which was supported by the stopper 71 receives a centrifugal force generated in the direction toward the grip 24. Thus, the valve body 70 is guided by the tapered portion 60 in the release channel 54, makes a displacement as indicated by an arrow b in FIG. 2 toward the ring-like member 68, and is attached to the ring-like member 68, bringing the state back to the closed state.

In the process from the address (A in FIG. 3) to the finishing (H in FIG. 3) in which the valve body 70 shifts from the closed state to the open state and then returns to the closed state again as described above, the amount of the balancing material 34 which is shifted from the first portion 28 to the inside of the club head 20 is the same as the amount of the balancing material 34 which was held in the holder portion 52. In other words, during the time when the player makes a series of swing actions, the valve body 70 makes a round trip from the closed state→the open state→the closed state, and approximately one gram of the balancing material 34 inside the first portion 28 moves into the club head 20. Therefore, when the player has completed 40 swings, approximately all of the balancing material 34 inside the first portion 28 has been shifted to inside the club head 20, and the swing balance of the golf club 10 reaches its maximum.

Meanwhile, during the swing process from the back swing to the top swing (B through D in FIG. 3) as described above, the club head 20 is raised higher than the grip 24, and because of this, the balancing material 34 which has been shifted to inside the club head 20 tends to flow in the reverse direction toward the base end portion 22 due to its weight. However, the flat end surface 86 on the club head 20 side in the balance holder 36 makes it difficult for the balancing material 34 to make the reverse flow and therefore, very little amount of the balancing material 34 flows back through the communication hole 90, and the swing balance which was increased by the swing is maintained.

As described above, a setting is made so that one swing will cause approximately one gram of the balancing material 34 to shift from the first portion 28 to the club head 20 which is at the tip of the golf club 10, with the first portion 28 loaded with forty grams of the balancing material 34 so that the swing balance is minimum. With the setting as described above, the swing balance of the golf club 10 increases by approximately 0.85 pounds per swing when measured with a 14-inch swing balancer.

For example, assume that the swing balance measures C8 under the balance setting before practice (the state where all of the balancing material 34 is loaded inside the first portion 28). After ten swings, ten grams of the balancing material 34 is shifted. In other words, the club head 20 becomes heavier by ten grams while the first portion 28 of the shaft 14 becomes lighter by 10 grams. Therefore, the swing balance increases by 8.5 points, and is now D6.5.

Since the amount of counterbalance has been reduced by ten grams, i.e., to thirty grams, upon completion of ten swings, the swing balance will shift by approximately 0.75 points per swing from the eleventh swing to the twentieth swing, and upon completion of the twentieth swing, the swing balance will be greater by 7.5 points, i.e., will be E4. Until the twentieth swing or so, the club head 20 is light and the swing load is not very much dissimilar from those of normal golf clubs. Therefore, the burden on the player is light, and it provides a benefit of warming up to the body while providing a benefit of training fast-twitch muscles for improved swing speed.

Since the amount of counterbalance has been reduced to twenty grams upon completion of twenty swings, the swing balance will shift by approximately 0.65 points per swing from the twenty-first swing to the thirtieth swing, and upon completion of the thirtieth swing, the swing balance will be greater by 6.5 points, i.e., will be F0.5. Starting from the twentieth swing or so, the weight of the club head 20 will become conspicuous, and gradually the player becomes aware of the swing load. Therefore, there is naturally induced a swing action which involves an integral use of the arms and the body, with a benefit of training slow-twitch muscles for improved swing power.

Since the amount of counterbalance has been reduced to ten grams upon completion of thirty swings, the swing balance will shift by approximately 0.45 points per swing from the thirty-first swing to the fortieth swing, and upon completion of the fortieth swing, the swing balance will be greater by 4.5 points, i.e., will be F5, i.e. the swing balance will be a maximum.

Figure 4:
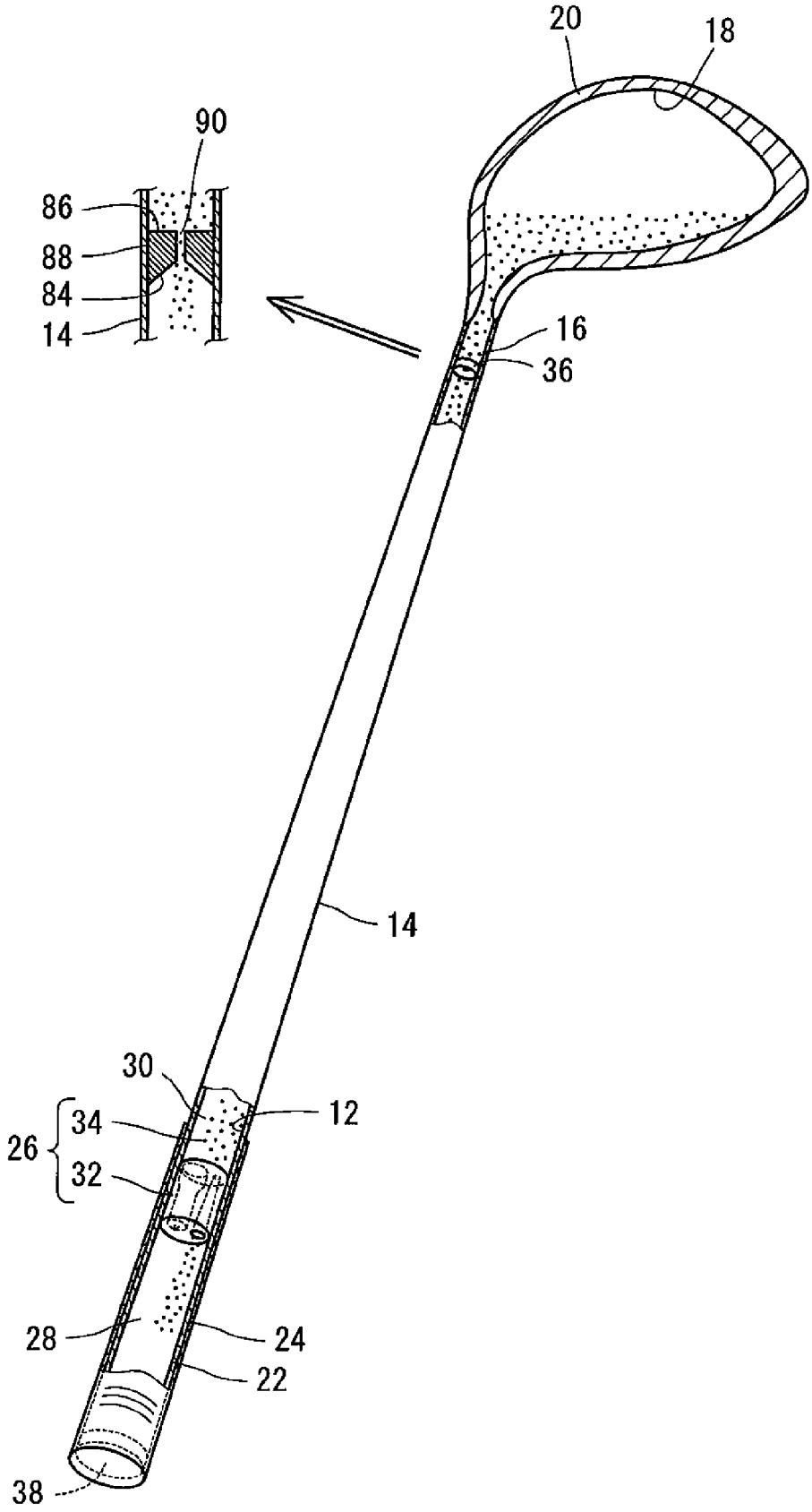
FIG. 4 is a diagram showing a golf club held upside down to allow a balancing material to return to a first portion.
Figure 5:
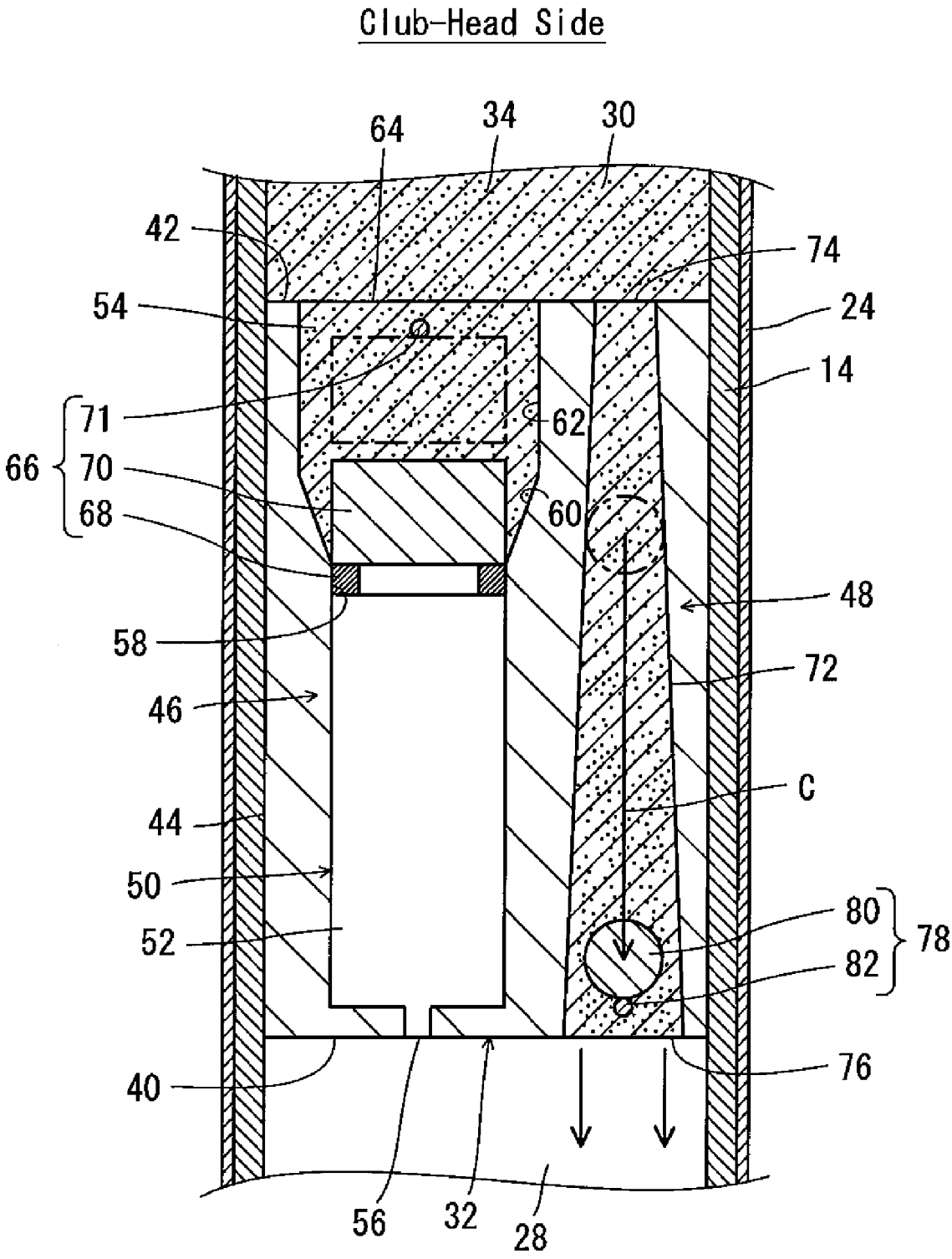
FIG. 5 is a longitudinal sectional view showing a configuration of the partitioning portion, with a club head pointing upward.

On the other hand, in order to reset the swing balance to the minimum, the golf club 10 is kept in an attitude as shown in FIG. 4, with the club head 20 on the upside and the grip 24 on the downside. Then, as indicated by an arrow c in FIG. 5, the valve body 80 makes a displacement by its weight, from the closed state where the second communication portion 72 is closed to the open state where the second communication portion 72 is opened, and in this open state setting, the second valve mechanism 78 is enabled to return the balancing material 34 to the first portion 28. Keeping the golf club 10 in the above-described attitude allows the balancing material 34 inside the club head 20 to flow out by its weight, through the shaft 14 toward the base end portion 22, flows through the communication hole 90 in the balance holder 36 and returns to the partitioning portion 26, and then flows through the inflow opening 74 in the second shifter portion 48, the second communication portion 72 and the outflow opening 76, and eventually back to the inside of the first portion 28.

When resetting of the balancing material 34 back to the first portion 28 is complete as described, the golf club 10 is put back as shown in FIG. 1, to take an attitude with the club head 20 on the downside and the grip 24 on the upside. Then, as illustrated in solid lines in FIG. 2, the valve body 80 returns by its weight, to the closed state where the second communication portion 72 is closed.

According to the golf club 10 as described, the swing balance of the golf club 10 increases each time the player swings the golf club 10. In other words, it is possible to increase the swing load gradually each time the swing is made. Therefore, it is possible to gradually induce a swing action achieved by integral use of the arms and the body while the player may not be particularly aware and while abrupt increase in the swing load on the player's muscles, joints and other parts of the body is avoided. As a result, it is possible to correct the swing path without too much burden, to make muscle training for the swing and to improve on head speed and swing power. Further, the player can hit balls just as with a normal golf club, so he should only concentrate on hitting the ball in his practice in a golf driving range, just as he would do in his normal round of play in order to correct his swing path. Thus, it has become possible to master a proper swing path easily without too much burden while hitting balls.

Also, the shaft 14 may be provided by a commercially available normal golf club shaft, and the balance-shifting means 26 may be added inside the hollow space of the shaft 14. Therefore, while offering all functions as provided in existing normal golf clubs, it is possible to change the swing balance easily, by shifting the balancing material 34 inside the golf club 10.

Further, as the golf club 10 is swung, a centrifugal force develops to act from the base end portion 22 toward the tip portion 16 of the golf club 10, and this centrifugal force is utilized to activate the first valve mechanism 66 to open the opening 58 on the second portion 30 side of the holder portion 52, so that the balancing material 34 which was held in the holder portion 52 moves to the second portion 30 side. By using the first valve mechanism 66 which is activated by a centrifugal force as described, it becomes possible to constitute the balance-shifting means 26 which is not dependent upon a dedicated drive-power source (such as a motor) or upon a starting operation by the player for moving the balancing material 34. Therefore, it becomes possible to constitute the balance-shifting means 26 simply and in small size, which facilitates mounting into the golf club 10. Also, the player does not have to disturb himself in order to make a shifting operation of the swing balance in his practice, which can enhance the effectiveness of repetition.

Also, the balancing material 34 shifts between the shaft 14 and the club head 20 in the golf club 10 and therefore, it is possible to increase the range in which the swing balance changes, i.e., the effectiveness of shifting. Also, as the position of the partitioning portion 32 in the shaft 14 is made closer to the base end portion 22 of the shaft 14, the balancing material 34 moves within a longer distance, and in this way, it is possible to increase the range in which the swing balance changes, i.e., to increase the effectiveness of shifting.

Further, it is possible to restrain the balancing material 34 which has moved to the club head 20 side from returning to the first portion 28 while a swing is being made. Therefore, it is possible to avoid reversing of the shift balance which has been increased by the swing, and to maintain the shift balance.

As the golf club 10 is swung repeatedly, the balancing material 34 inside the first portion 28 moves through the first shifter portion 46 to inside the club head 20, whereby the swing balance of the golf club 10 increases. Then, if it is desired that the swing balance be decreased, it is possible to decrease the swing balance of the golf club 10, by returning the balancing material 34 which was shifted to the second portion 30 side, to the first portion 28 via the second shifter portion 30. This is advantageous particularly when resetting the swing balance to a minimum after it has reached a maximum. This arrangement allows repeated practice with the golf club 10.

Further, when returning the balancing material 34 which was shifted into the club head 20 to the first portion 28, it is only required to keep the golf club 10 in a certain attitude, with the club head 20 on the upside and the grip 24 on the downside, and then the valve body 80 in the second valve mechanism 78 will move by its weight and opens the second communication portion 72. Thus, the balancing material 34 on the second portion 30 side moves, due to its weight, through the second communication portion 72 toward the first portion 28, and decreases the swing balance. Therefore, there is no need for a dedicated drive-power source (such as a motor) in order to return the balancing material 34 to the first portion 28, and it is possible to simplify the structure of the golf club 10.

It should be noted here that since the end surface 86 of the balance holder 36 is flat, putting the golf club 10 simply upside down (with the club head 20 on the upside and the grip 24 on the downside) will allow some of the balancing material 34 from inside the club head 20 to remain on the end surface 86. However, it is possible to let the balancing material 34 flow into the communication hole 90 by holding the golf club 10 at the same attitude and shaking it several times in parallel to the ground. The balance holder 36 may be provided inside the club head 20.

According to the above-described embodiment, a second shifter portion 48 which is adjacent to the first shifter portion 46 is provided inside the partitioning portion 32. However, the present invention is not limited to this. For example, instead of the second shifter portion 48, an openable/closable lid may be provided on the bottom of the club head 20 and on the upper end of the grip 24. In this case, in order to return the balancing material 34 which is already shifted into the club head 20 to the first portion 28, first, the lid on the bottom of the club head 20 is opened, and the balancing material 34 is removed from the club head 20. Then, the lid on the upper end of the grip 24 is opened and the balancing material 34 which was removed from the club head 20 is returned into the first portion 28, from the upper end of the grip 24.

Also, according to the above-described embodiment, description was made for a case where the balancing material 34 is shifted from the first portion 28 on the base end portion 22 side in the shaft 14 to the hollow portion 18 in the club head 20. However, the present invention is not limited to this.

Figure 6:
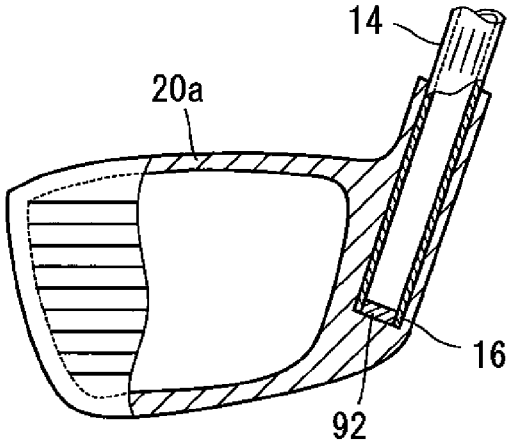
FIG. 6 shows how a club head (wood type) may be attached to a shaft.
Figure 6:
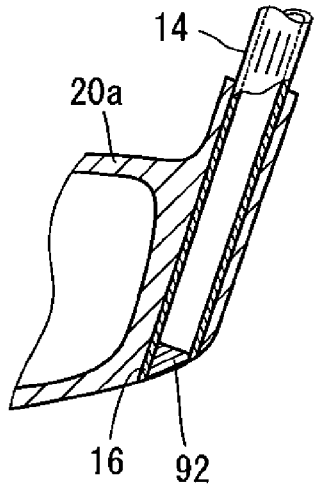
Figure 7:
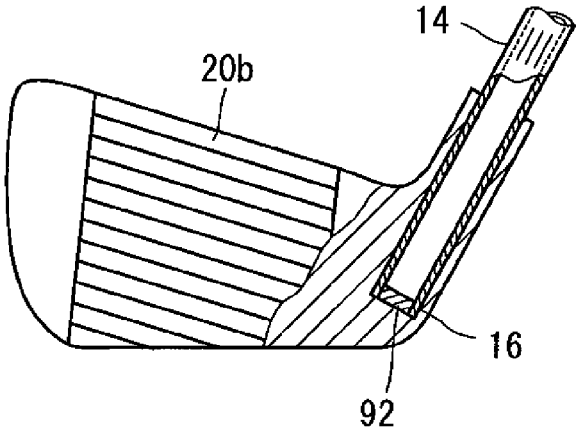
FIG. 7 shows how a club head (iron type) may be attached to a shaft.
Figure 7:
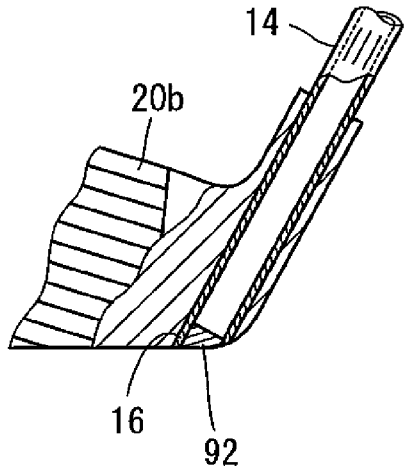

The balancing material 34 may be shifted from the first portion 28 to the second portion 30 in the shaft 14. In this case again, a good balance-shifting effect is achieved. Particularly, it is preferable that the balancing material 34 is shifted from the first portion 28 to a tip portion (the tip portion 16 inside the shaft 14) of the second portion 30. In the case where the balancing material 34 is shifted from the first portion 28 to the second portion 30, the club head which is mounted on the shaft 14 may not only be the club head 20*a* which is a hollow, wood-type head, but also be a club head 20*b* which is a solid, iron-type as shown in FIG. 6 and FIG. 7, or any club head may be mounted, and it is easy to meet different needs. In this case, the tip portion 16 in the shaft 14 is sealed by a lid 92.

Whether the club head is a hollow-type club head 20*a* or a solid-type club head 20*b*, an applicable connection method between the shaft and the club head in the golf club may be whichever of a non-shaft-penetration method shown in FIG. 6(*a*) and FIG. 7(*a*) and a shaft-penetration method shown in FIG. 6(*b*) and FIG. 7(*b*).

Further, according to the above-described embodiment, the ring-like member 68 in the first valve mechanism 66 is made of metal material while the valve body 70 is made of a magnet. However, the present invention is not limited to this. The ring-like member 68 may be a magnet and the valve body 70 may be metal. Also, the shape of valve body 70 is not limited to columnar but may be spherical.

In the case where the ring-like member 68 is a magnet and the valve body 70 is spherical metal, it is preferable that the ring-like member 68 has an outer diameter of 6 mm×an inner diameter of 2 mm×a height of 2.5 mm, and a magnetic flux density of 0.075 T through 0.08 T whereas the valve body 70 has a diameter of 7 mm and a mass of 1.39 grams.

According to the above-described embodiment, the valve body 70 in the first valve mechanism 66 is urged magnetically to the closed state. However, the urge may be provided by a spring.

The balancing material 34 is not limited to glass powder, but may be provided by any material which is movable inside the golf club 10. For example, lead power or mercury may be used.

The first valve mechanism may have an openable/closable release opening 64. In this case, the holder portion 52 and the release channel 54 shown in FIG. 2 virtually define the holder portion which holds a predetermined amount of the balancing material 34 whereas the release opening 64 virtually defines the opening on the second portion 30 side.

The present invention being thus far described and illustrated in detail, it is obvious that these description and drawings only represent examples of the present invention, and should not be interpreted as limiting the invention. The spirit and scope of the present invention is only limited by words used in the accompanied claims.

The invention claimed is:

1. A practice golf club, comprising:

a hollow shaft;

a club head provided at a tip portion of the shaft;

a grip provided at a base end portion of the shaft; and a balance-shifting unit for increasing a swing balance of the golf club in association with each swing, the balance-shifting unit including:

a partitioning portion for dividing an inside of the shaft into a first portion on the base end portion side and a second portion on the tip portion side; and a balancing material, wherein the partitioning portion includes a first shifter portion for moving the balancing material held in the first portion to the second portion side in association with a swing of the golf club; and the first shifter portion includes:

a first communication portion which has a holder portion for holding a predetermined amount of the balancing material from the first portion and provides communication between the first portion and the second portion via the holder portion; and a first valve mechanism capable of opening and closing an opening on the second portion side of the holder portion;

the first valve mechanism opening the opening on the second portion side of the holding portion by using a centrifugal force generated by a swing of the golf club.

2. The golf club according to claim 1, wherein the balancing material inside the first portion is moved to the second portion in association with a swing of the golf club.

3. The golf club according to claim 1, wherein the balancing material inside the first portion is moved to inside of the club head via the second portion in association with a swing of the golf club.

4. The golf club according to claim 1, further comprising a balance holder for restraining the balancing material, which was moved to the second portion side, from returning to the first portion during a swing of the golf club.

5. The golf club according to claim 4, wherein the partitioning portion further includes a second shifter portion for returning the balancing material on the second portion side to the first portion.

6. A practice golf club, comprising:

a hollow shaft, a club head provided at a tip portion of the shaft;

a grip provided at a base end portion of the shaft;

a balance-shifting unit for increasing a swing balance of the golf club in association with each swing, the balance-shifting unit including:

a partitioning portion for dividing an inside of the shaft into a first portion on the base end portion side and a second portion on the tip portion side; and a balancing material; and a balance holder for restraining the balancing material that was moved to the second portion side from returning to the first portion during a swing of the golf club, wherein the partitioning portion includes a first shifter portion for moving the balancing material held in the first portion to the second portion side in association with a swing of the golf club and a second shifter portion for returning the balancing material on the second portion side to the first portion; and the second shifter portion includes:

a second communication portion for providing communication between the second portion and the first portion for moving the balancing material from the second portion side to the first portion; and a second valve mechanism capable of opening and closing the second communication portion;

the second valve mechanism using its weight to open the second communication portion.

* * * * *